US006727855B1

(12) United States Patent
Nalbandian

(10) Patent No.: US 6,727,855 B1
(45) Date of Patent: Apr. 27, 2004

(54) FOLDED MULTILAYER ELECTRICALLY SMALL MICROSTRIP ANTENNA

(75) Inventor: Vahakn Nalbandian, Ocean, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 8 days.

(21) Appl. No.: 10/301,040

(22) Filed: Nov. 21, 2002

(51) Int. Cl.[7] ..... H01Q 1/38
(52) U.S. Cl. ..... 343/700 MS; 343/846
(58) Field of Search ..... 343/700 MS, 846, 343/848, 803

(56) References Cited

U.S. PATENT DOCUMENTS 5,781,158 A * 7/1998 Ko et al. ..... 343/700 MS
6,278,369 B2 * 8/2001 Smith et al. ..... 340/572.7
6,593,888 B2 * 7/2003 Fu ..... 343/700 MS
6,677,901 B1 * 1/2004 Nalbandian ..... 343/700 MS

* cited by examiner

*Primary Examiner*—Tan Ho
(74) *Attorney, Agent, or Firm*—Michael Zelenka; George B. Tereschuk

(57) ABSTRACT

A folded multilayer electrically small compact microstrip antenna provides an electrically small antenna for the lower frequencies. The folded multilayer electrically small compact microstrip antenna employs a folding radiation strip is divided into segments and is interleaved with a multiple layered microstrip dielectric substrate and a means for a conductive ground plane having a number of conductive branches. A narrow portion of the radiating strip, a coaxial connector, and a first conductive branch are positioned so that a wide portion of the radiating strip provides a given impedance and the narrow portion causes a reduced effective impedance at a junction point. The reduced impedance provide a shortened antenna length that operates at VHF and HF frequencies. The different embodiments of this invention's folded multilayer electrically small compact microstrip antenna include 2, 3 and 5 dielectric layers. This invention also encompasses methods for providing substantial reduction in antenna size at the HF and VHF frequencies with a folded multilayer electrically small compact microstrip antenna by interleaving a folding radiating strip, a multiple layered dielectric substrate and a conductive ground plane means with several conductive branches.

74 Claims, 3 Drawing Sheets

FOLDED MULTILAYER ELECTRICALLY SMALL MICROSTRIP ANTENNA

GOVERNMENT INTEREST

The invention described herein may be manufactured, used, imported, sold, and licensed by or for the Government of the United States of America without the payment to me of any royalty thereon.

FIELD OF THE INVENTION

The present invention relates generally to the field of microstrip antennas, and more particularly to planar tunable microstrip antennas for the HF and VHF frequencies.

BACKGROUND OF THE INVENTION

Microstrip antennas with a lightweight, low profile, low cost and planar structure have been replacing bulky antennas. The length of a rectangular microstrip antenna is about a half wavelength within the dielectric medium under the radiating patch, which is still relatively large at UHF and VHF frequencies, but these frequencies can impose size limitations resulting in bulky and cumbersome antenna structures. Due to the size limitation at UHF and VHF frequencies, previously available microstrip antennas were mainly limited to applications at higher frequencies. The disadvantage of size limitations in UHF and VHF has created a long-felt need to reduce antenna length. Up until now, it has not been possible to employ planar microstrip antennas without the disadvantages, limitations and shortcomings associated with antenna length and size. The present invention makes it possible to fulfill the need for an electrically small planar microstrip antenna for the HF and VHF frequencies.

The long-awaited electrically small planar microstrip antenna for the HF and VHF frequencies offers an number of advantages over prior art antennas. Prior art rectangular microstrip antennas have a half wavelength length within the dielectric medium under the radiating patch, and this is extremely large at UHF and VHF frequencies. The electrically small planar microstrip antenna of the present invention provides the same high efficiency as conventional microstrip antennas, but it also offers a number of key advantages that permit significant decreases in antenna size, without suffering from the size limitations of prior art antenna structures. The present invention also fulfills the long-felt and unsatisfied need for an electrically small antenna for the lower frequencies.

The present invention fulfills the long-standing need for a significantly reduced antenna length and an electrically small antenna for the lower frequencies with a microstrip antenna structure fabricated with a simple microstrip material. This invention's electrically small planar microstrip antenna also provides the additional advantage of being configured so that it can be easily tunable. The present invention also advantageously provides an antenna with the same high efficiency as quarter wavelength monopole and conventional microstrip antennas, but with an antenna length shortened to less than about 5% of the length of a monopole antenna or conventional microstrip antenna, resulting in small microstrip antennas at low frequencies such as HF and VHF without suffering from the disadvantages, shortcomings limitations of prior art microstrip antennas.

SUMMARY OF THE INVENTION

It is an object of this invention to provide a folded multilayer electrically small compact microstrip antenna.

It is another object of this invention to provide a folded multilayer electrically small compact microstrip antenna that permits a substantial reduction in antenna size.

It is yet another object of this invention to provide a folded multilayer electrically small compact microstrip antenna that permits a substantial reduction in antenna size and operates efficiently at low HF and VHF frequencies.

It is still another object of this invention to a simple, low-cost folded multilayer electrically small compact microstrip antenna that permits a substantial reduction in antenna size and operates efficiently at low HF and VHF frequencies.

To fulfill the long-felt and heretofore unsatisfied needs for an electrically small antenna for the lower frequencies and to advantageously attain and accomplish these and other objects the present invention provides a folded multilayer electrically small compact microstrip antenna comprising a folding radiating strip divided into segments interleaved with a multiple layered microstrip dielectric substrate and a means for a conductive ground plane having a number of conductive branches. A narrow portion of the radiating strip, a coaxial connector, and a first conductive branch are positioned so that a wide portion of the radiating strip provides a large junction at the top layer of the multilayer structure. This shortens the length of microstrip impedance transition and greatly reduces the size of the antenna. This impedance transition, in addition to the multilayer structure, provides an extremely shortened antenna length that operates at VHF and HF frequencies. The different embodiments of this invention's folded multilayer electrically small compact microstrip antenna include 2, 3 and 5 dielectric layers. This invention also encompasses methods for providing substantial reduction in antenna size at the HF and VHF frequencies with a folded multilayer electrically small compact microstrip antenna comprising the steps of interleaving a folding radiating strip, a dielectric substrate interleaved and a conductive ground plane means having several conductive branches.

DETAILED DESCRIPTION OF THE DRAWINGS

The folded multilayer electrically small compact microstrip antenna of the present invention advantageously comprises a radiating strip, a multilayer microstrip dielectric substrate, and a conductive ground plane means in an innovative stacking arrangement that provides an electrically small, substantially shortened microstrip antenna in the HF and VHF frequencies. The folded radiating strip and the arrangement of the top segment of the radiating strip results in a significantly reduced antenna length that is substantially shorter than conventional prior art microstrip antennas for the HF and VHF frequencies, without suffering from any of the disadvantages, drawbacks and limitations associated with much longer prior art conventional antennas.

The size of any microstrip antenna is determined by the wavelength within the substrate. For example, the length of a rectangular microstrip antenna is about half of the wavelength within the dielectric medium under a radiating patch. In order to reduce the size of the radiating element or radiating strip, the dielectric constant must be increased substantially, but this makes the antenna operate inefficiently, which is not desirable. This invention's folded multilayer electrically small compact microstrip antenna, particularly the folded radiating strip, advantageously provides a significant reduction in antenna length for HF and VHF microstrip antennas by making partial wavelength be the sum of multiple dielectric layers. In addition a junction of the two different strip widths in the middle of the top folding radiating strip shortens the length of the impedance transition from the center point, where the wave impedance vanishes, to the edge of the radiating strip, where the impedance becomes very large. The effective impedance to be satisfied by the narrower strip at the junction is greatly reduced by the presence of the junction of two different sized top radiating segments. Multilayer dielectric construction plus the junction of the two strips on the top layer decreases the size of the antenna greatly for the required frequency range.

Figure 1:
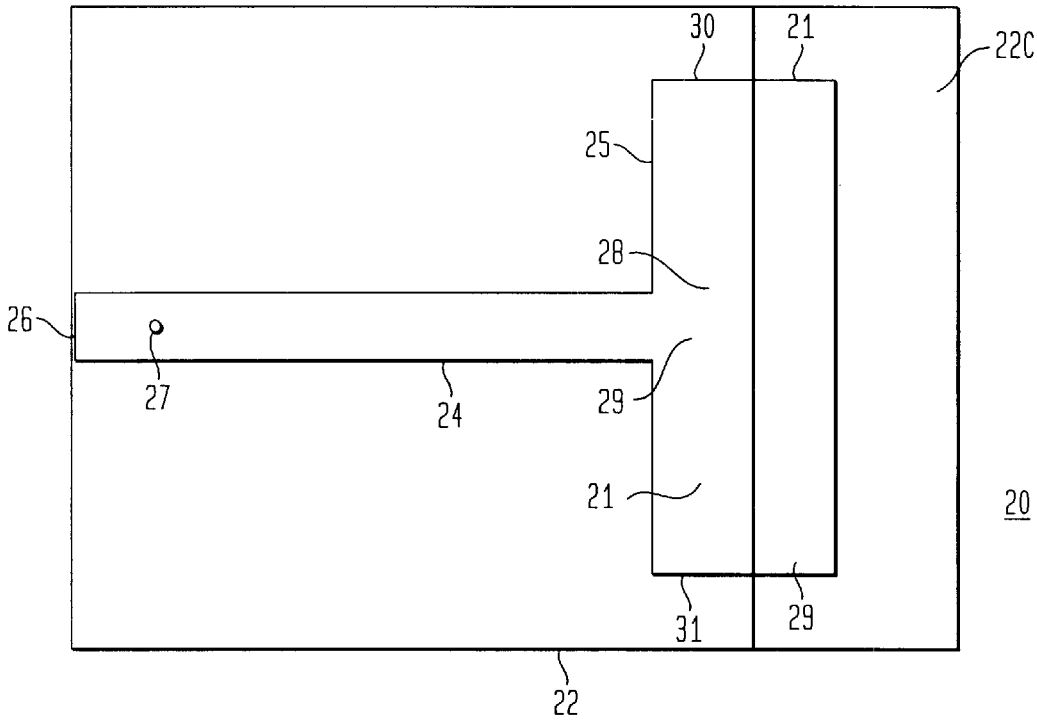
FIG. 1 is a top view of the triple-layer embodiment of the present invention.

Referring now to the drawings, FIG. 1 is a top view of the folded multilayer electrically small compact microstrip antenna 20 in the triple layer embodiment of the present invention with a folding radiating strip 21 stacked on a top microstrip dielectric substrate layer 22A. The folding radiating strip 21 further comprises a thin portion 24 and a wide portion 25. The thin portion 24 having a narrow end 26 shorted to part of the conductive ground plane 23, not shown in this drawing, near an RF connector center pin 27, which is projecting downward through the top dielectric substrate layer 22A to the center of the RF connector. It should be noted that that the innovative use of a multiple layered dielectric substrate enfolded within a folding radiating strip 21 makes possible the significant antenna length reductions of the present invention. The wide portion 25 further comprises a central region 28 adjacent to the thin portion 24 and a junction 29 in the central region 28. In this embodiment, the folding radiating strip 21 is folded into a number of segments interleaved with the dielectric substrate layers 22A–22C and the conductive branches 23 and 32. A similar arrangement is used in all embodiments of this invention.

Figure 2:
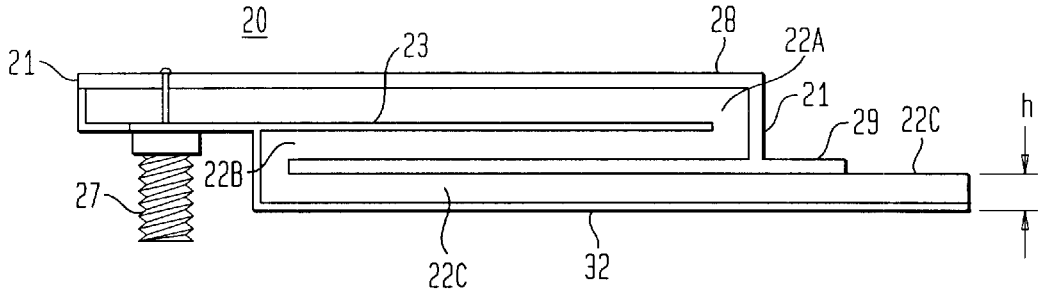
FIG. 2 is a cutaway side view of the triple-layer embodiment of the present invention.

FIG. 2 is a cutaway side view of the triple layer embodiment of the folded multilayer electrically small compact microstrip antenna 20 of the present invention, using like numerals for like structures and not drawn to scale, with the first conductive branch 23 of the conductive ground plane means sandwiched between the top dielectric substrate layer 22A and middle dielectric substrate layer 22B. RF connector center pin 27 projects through the top dielectric substrate layer 22A and is connected to the top of narrow strip 24. Adjusting the distance between RF connector center pin 27 and the shorted end of the narrow strip 24 depicted in FIG. 1, will adjust the antenna input impedance to the impedance of the RF connector 27. Folding radiating strip 21 is folded into a top radiating segment 28 and a bottom-radiating segment 29. Bottom radiating segment 29 folds in between middle dielectric substrate layer 22B and bottom dielectric substrate layer 22C, respectively, and extends slightly outward to cover a portion of the bottom dielectric substrate layer 22C. An essential aspect of the present invention is the ability to fold the radiating strip 21 numerous times without degrading the antenna's efficiency and radiation characteristics. The second conductive branch 32 is disposed below the first conductive branch 23 and the bottom dielectric substrate layer 22C.

Referring now back to FIG. 1, the wide edges 30 and 31 of top segment 28 contribute to the antenna's radiation pattern which demonstrates that an odd number of dielectric substrate layers causes radiation to be on the same side as the FIG. 2 first conductive branch 23 and second conductive branch 32, which results in a directional antenna pattern. FIG. 1 also illustrates a top view of a portion of bottom segment 29 protruding over the bottom dielectric substrate layer 22C. This triple-layer embodiment employs a first conductive branch 23 and a second conductive branch 32 as a continuous conductive ground in the conductive ground plane means. It is also within the contemplation of the present invention to employ a lesser or greater number of branches or platforms to allow for other stacking arrangements for both the multiple dielectric substrate layers and the folding radiation strip 21. Additionally, when folding radiating strip 21 is unfolded it performs the same way as this invention's folding radiating strip, except that when it is unfolded it provides an undesirable length and size for certain applications that require a small, unobtrusive antenna. It is also noted that a bigger ratio between wide portion 25 and thin portion 24 affords an improved shrinkage. For the sake of simplicity, a planar ground plane is depicted in the drawings; however, other shapes and geometrical configurations are also within the contemplation of the present invention so long as they provide sufficient length for folding and stacking. Folding radiating strip 21 may be made from any conductive metal, and in the preferred embodiment it is composed of copper. The first and second conductive branches 23 and 32 may also be made from conductive materials such as copper and aluminum.

Referring back to FIG. 1, in all embodiments, the top segment 28 of the folding radiating strip 21 is stacked on top dielectric substrate layer 22A to provide a junction 29 in the central region 28 opposing the narrow end 26 of the folding radiating strip 21, which is shorted to the first conductive branch 23. This arrangement shortens the length of the impedance transition and provides significantly reduced effective impedance, which is satisfied by the thin portion 24 of the radiating strip 21. The simplest example of significantly reduced effective impedance is a microstrip antenna with two rectangular patches of different widths that are connected to each other, where the end of the narrower patch is shorted, as is the case in FIG. 1. The effective impedance to be satisfied by the narrower strip at the junction is greatly reduced by the junction. While this technique can decrease the size of planar antennas by a factor of 10 to make them useful at upper VHF and UHF frequencies, this technique is inadequate to answer the longstanding need for a shortened antenna capable of reaching the lower HF range (3 MHz). Thus, this invention makes the antenna compact and usable for moving platforms.

In accordance with the present invention, the top segment 28 alone provided a resonant frequency of 626 MHz, and after fabricating the entire three layer device the total length increased by 18%, which should have resulted in a one layer frequency of 530 MHz. The triple layer embodiment of the folded multilayer electrically small compact microstrip antenna 20 of the present invention can provide a resultant frequency of 191 MHz, which results in an antenna almost three times shorter than a conventional single layer microstrip antenna. The present invention focuses the antenna length reduction effort on the multiple enfolding of the folding radiating strip 21 onto, and within, the multiple dielectric substrate layers 22A–22C to reduce the wavelength within the microstrip media without making the antenna inefficient.

Figure 3:
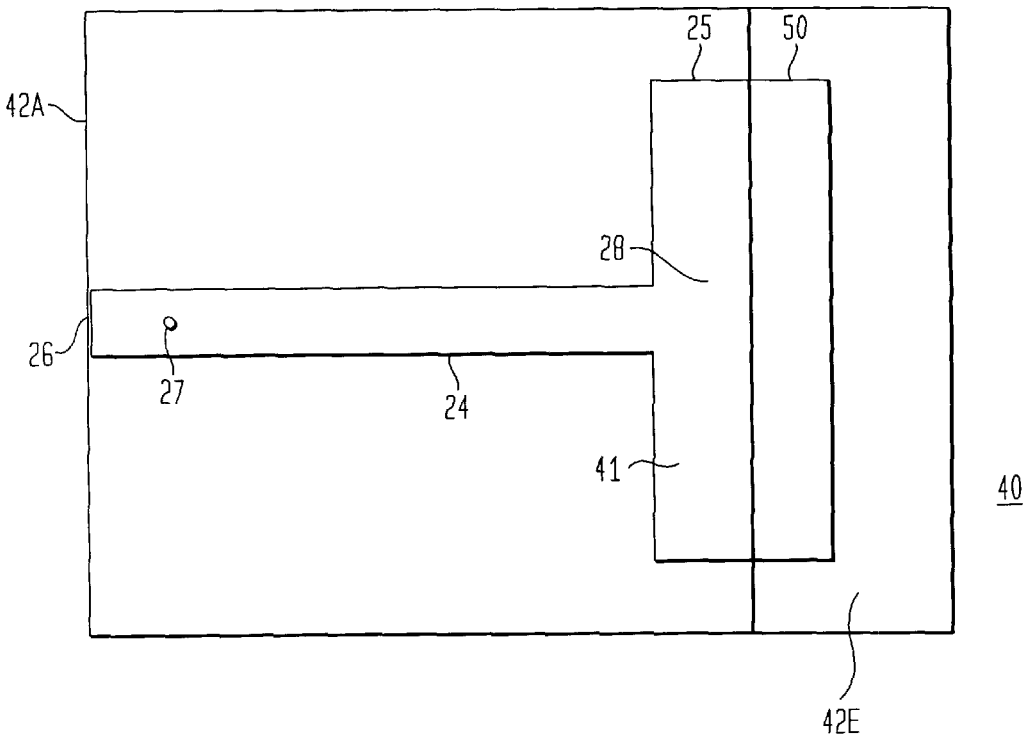
FIG. 3 a top view of the five-layer embodiment of the present invention.

Another embodiment of this invention's folded multilayer electrically small compact microstrip antenna encompasses a five-layered dielectric substrate. Referring now to the FIG. 3, which is an exploded top view of the folded multilayer electrically small compact microstrip antenna 40 in the five layer embodiment of the present invention, where like numerals will be employed for like structures, a folding radiating strip 41 is stacked on a top microstrip dielectric substrate layer 42A. The folding radiating strip 41 further comprises a thin portion 24 and a wide portion 25. The thin portion 24 having a narrow end 26 shorted to a first conductive branch 43 and an RF connector 27 projecting downward through the top dielectric substrate layer 42A to a first conductive branch 43, not shown in this drawing, of a conductive ground plane means. The wide portion 25 further comprises a central region 28 adjacent to the thin portion 24.

Figure 4:
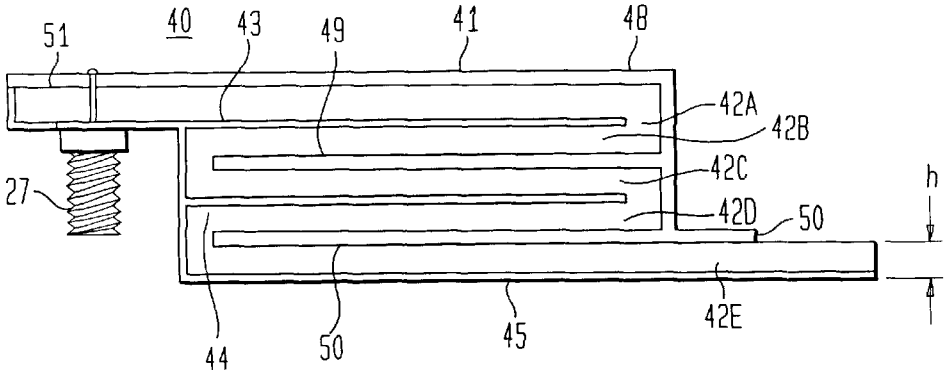
FIG. 4 is a cutaway side view of the five-layer embodiment of the present invention.

FIG. 4 is a cutaway side view of the five layer embodiment of the folded multilayer electrically small compact microstrip antenna 40 of the present invention, not drawn to scale, using like numerals for like structures, with the first and second conductive branches, 43 and 44, respectively, of the conductive ground plane means sandwiched between microstrip dielectric substrate layers 42A–42E. The center pin of the RF connector 27 projects through dielectric substrate layer 42A and is soldered to the narrow strip 24 and an outer surface of RF connector 27 is connected to the first conductive branch 43. Folding radiating strip 41 is folded into a top segment 48, middle segment 49 and a bottom segment 50. Middle segment 49 is sandwiched between dielectric substrate layers 42B and 42C. The bottom segment 50 is sandwiched between dielectric substrate layers 42D and 42E and extends outward slightly onto an exposed portion of bottom dielectric substrate layer 42E. The second conductive branch 44 is disposed below the first conductive branch 43 and a third conductive branch 45 is disposed beneath bottom dielectric substrate layer 42E. The first, second and third conductive branches 43–45, respectively can be a continuous piece of conductive material or separate segments of conductive material fastened together by solder or a suitable epoxy. The first, second and third conductive branches 43–45, respectively can be composed of any conductive material, such as copper and aluminum, and are made of copper in the preferred embodiment. Folding radiating strip 41 may be made from any conductive metal, and in the preferred embodiment it is composed of copper.

In operation, the five-layered embodiment of the folded multilayer electrically small compact microstrip antenna 40 of the present invention is similar to the triple layered embodiment depicted in FIG'S 1 and 2. It is also noted that an odd number of dielectric substrate layers leads to a directional antenna pattern. In accordance with the present invention, the top segment 48 alone provided a resonant frequency of 476 MHz, and an electrical length of 50 mm, and after fabricating the entire five layer device the antenna 40 of the present invention can provide a resultant frequency of 125 MHz and an electrical length of 190 mm, which results in an antenna almost one fifth the length of conventional microstrip antennas. The five-layer embodiment provides an electrical length ratio to the top segment of 3.8:1.

Figure 5:
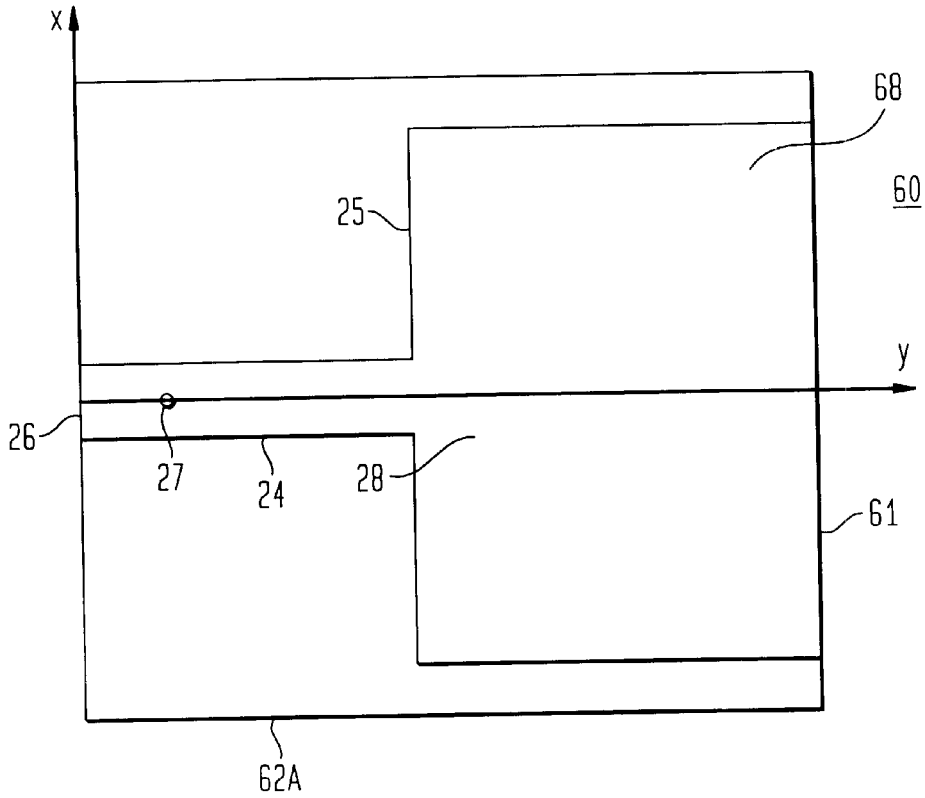
FIG. 5 a top view of the double-layer embodiment of the present invention.

Another embodiment of this invention's folded multilayer electrically small compact microstrip antenna is a double-layered dielectric substrate. Referring now to the drawings, FIG. 5 is a top view of the folded multilayer electrically small compact microstrip antenna 60 in the double layer embodiment of the present invention, not drawn to scale, with like numerals employed for like structures, with a top segment 68 of the folding radiating strip 61 placed on a top microstrip dielectric substrate layer 62A. The top segment 68 further comprises a thin portion 24 and a wide portion 25. The thin portion 24 having a narrow end 26 shorted to a conductive ground plane means 63, not shown in this drawing, and a center pin of an RF connector 27 projecting downward through top dielectric substrate layer 62A to the center of the RF connector 27. The outer portion of RF connector 27 is soldered to the conductive ground plane means 63. The wide portion 25 further comprises a central region 28 adjacent to the thin portion 24.

Figure 6:
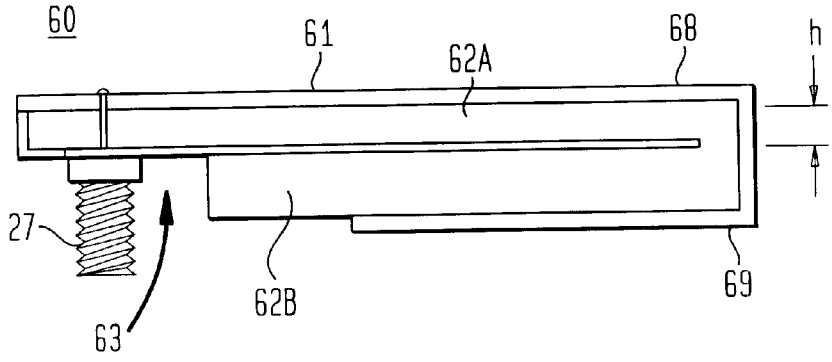
FIG. 6 is a cutaway side view of the double-layer embodiment of the present invention.

FIG. 6 is a cutaway side view of the double layer embodiment of the folded multilayer electrically small compact microstrip antenna 60 of the present invention, not drawn to scale, using like numerals for like structures, depicting the conductive ground plane means 63 sandwiched between top dielectric substrate layer 62A and bottom dielectric substrate layer 62B. RF connector 27 projects through the top dielectric substrate layer 62A and the outer portion of the RF connector 27 is connected to the conductive ground plane means 63. Folding radiating strip 61 is folded into a top segment 68 and a bottom segment 69. Bottom segment 69 folds under the bottom dielectric substrate layer 62B. This double-layer embodiment employs a single conductive ground plane means 63, but other embodiments employ a multi-level conductive ground plane means that is divided into several platforms or branches to allow for additional stacking levels for both the dielectric substrate and folding radiating strip. In this double-layer embodiment, the main radiating surfaces are wide portion 25 of top segment 68 and bottom segment 69 causing the antenna 60 to radiate at both ends of the conductive ground plane means 63 and thus provide an omnidirectional radiating pattern. The same results would apply for any other embodiment employing an even number of dielectric substrate layers. Folding radiating strip 61 may be made from any conductive metal, and in the preferred embodiment it is composed of copper. By way of illustration, top dielectric substrate layer 62A and bottom dielectric substrate 62B are depicted with different thicknesses, and it is within the contemplation of this invention to construct the devices of the present invention with dielectric substrate layers having either the same or different thicknesses. The conductive ground plane 63 may also be made from conductive materials such as copper and aluminum.

Numerous variations of the electrically small planar tunable microstrip antenna are possible and considered within the contemplation of the present invention, such as selecting different metals for the folding radiating strip and the conductive ground plane means, constructing one of the dielectric substrate layers to be thicker than one of the folding radiating strip segments, a conductive branch being thinner than one of the dielectric substrate layers, disposing the coaxial connector orthogonal to the dielectric substrate layers, the number of dielectric substrate layers and selecting an odd or even number of dielectric substrate layers to provide the desired radiation pattern.

The present invention also encompasses a method for placing a folding radiation strip around multilayer microstrip dielectric substrate layers in electrically small compact microstrip antenna, comprising the steps of forming a multilayer microstrip dielectric substrate from a plurality of dielectric substrate layers, said antenna having a given length, $A_l$, forming a conductive ground plane means with a plurality of conductive branches, forming the folding radiating strip into a plurality of segments, including a top segment having a narrow portion, a narrow end and a wide portion and interleaving the folding radiating strip, said plurality of dielectric substrate layers and said plurality of conductive branches. The method of the present invention continues with the steps of connecting a coaxial connector to a first conductive branch, with the coaxial connector having an outer portion and a center pin, and the outer portion being connected to the first conductive branch, the center pin connected to the narrow end in the vicinity of a point where the top segment is shorted to the first conductive branch and an optimal impedance match is provided, providing a given impedance by placing the wide portion near a junction point opposing the narrow end, positioning a top layer of the dielectric substrate on top of the first conductive branch, the dielectric substrate having an effective impedance value and a decreased wavelength, the narrow portion causing a reduced effective impedance at the junction point and providing a shortened antenna length, $A_s$, that operates at VHF and HF frequencies due to the decreased wavelength and reduced impedance.

Numerous variations of the method of the present invention are possible and considered within the contemplation of the present invention, such as selecting different metals for the folding radiating strip and the conductive ground plane means, constructing one of the dielectric substrate layers to be thicker than one of the folding radiating strip segments, forming a conductive branch thinner than one of the dielectric substrate layers, disposing the coaxial connector orthogonal to the dielectric substrate layers, selecting the number of dielectric substrate layers and selecting an odd or even number of dielectric substrate layers to provide the desired radiation pattern.

It is to be understood that numerous other features and modifications to the foregoing detailed description are within the contemplation of the invention, which is not limited by this description. As will be further appreciated by those skilled in the art, any number of configurations, as well any number of combinations of circuits, differing materials and dimensions can achieve the results described herein. Accordingly, the present invention should not be limited by the foregoing description, but only by the appended claims.

What I claim is:

1. A folded multilayer electrically small compact microstrip antenna, comprising:

a microstrip dielectric substrate having a plurality of dielectric substrate layers;

a means for a conductive ground plane having a plurality of conductive branches;

a folding radiating strip folded into a plurality of segments is interleaved with said plurality of dielectric substrate layers and said plurality of conductive branches;

a top segment is stacked on a top dielectric substrate layer, said top dielectric substrate layer is stacked on a first conductive branch;

said top segment having a narrow portion, a narrow end and a wide portion;

a coaxial connector having an outer portion and a center pin, said outer portion being connected to said first conductive branch, said center pin being connected to said narrow end in the vicinity of a point where said top segment is shorted to said first conductive branch and an optimal impedance match is provided;

said wide portion, having a central region near said narrow portion and a junction point opposing said narrow end, provides a given impedance;

said antenna having a given length, $A_l$;

said plurality of dielectric layers having an effective impedance value; and said narrow portion causing a reduced effective impedance at said junction point to provide a shortened antenna length, $A_s$, that operates at VHF and HF frequencies.

2. The folded multilayer electrically small compact microstrip antenna, as recited in claim 1, further comprising said shortened antenna length, $A_s$, being less than said given length, $A_l$.

3. The folded multilayer electrically small compact microstrip antenna, as recited in claim 2, further comprising said folding radiating strip being composed of a first metal.

4. The folded multilayer electrically small compact microstrip antenna, as recited in claim 3, wherein said first metal is copper.

5. The folded multilayer electrically small compact microstrip antenna, as recited in claim 2, further comprising said conductive ground plane means being composed of a second metal.

6. The folded multilayer electrically small compact microstrip antenna, as recited in claim 5, further comprising said second metal being selected from the group consisting of aluminum and copper.

7. The folded multilayer electrically small compact microstrip antenna, as recited in claim 5, further comprising one of said plurality of dielectric substrate layers being thicker than one of said plurality of segments.

8. The folded multilayer electrically small compact microstrip antenna, as recited in claim 7, further comprising said first conductive branch being thinner than one of said plurality of dielectric substrate layers.

9. The folded multilayer electrically small compact microstrip antenna, as recited in claim 8, further comprising said coaxial connector being disposed orthogonal to said plurality of dielectric substrate layers.

10. The folded multilayer electrically small compact microstrip antenna, as recited in claim 9, wherein said plurality of dielectric layers is two layers.

11. The folded multilayer electrically small compact microstrip antenna, as recited in claim 10, further comprising said antenna provides an omnidirectional radiation pattern.

12. The folded multilayer electrically small compact microstrip antenna, as recited in claim 9, wherein said plurality of dielectric substrate layers is three layers.

13. The folded multilayer electrically small compact microstrip antenna, as recited in claim 12, further comprising a second conductive branch being positioned below said first conductive branch.

14. The folded multilayer electrically small compact microstrip antenna, as recited in claim 13, further comprising said antenna provides a directional radiation pattern.

15. The folded multilayer electrically small compact microstrip antenna, as recited in claim 14, further comprising a bottom dielectric substrate layer being stacked on said second conductive branch.

16. The folded multilayer electrically small compact microstrip antenna, as recited in claim 15, further comprising said antenna provides a resultant frequency of 191 MHz.

17. The folded multilayer electrically small compact microstrip antenna, as recited in claim 16, further comprising said shortened antenna length, $A_s$, being about three times shorter than said given length, $A_l$.

18. The folded multilayer electrically small compact microstrip antenna, as recited in claim 9, wherein said plurality of dielectric substrate layers is five layers.

19. The folded multilayer electrically small compact microstrip antenna, as recited in claim 18, further comprising:

a second conductive branch being positioned below said first conductive branch;

a third conductive branch being positioned below said second conductive branch; and said second conductive branch and said third conductive branch each being thinner than one of said plurality of dielectric substrate layers.

20. The folded multilayer electrically small compact microstrip antenna, as recited in claim 19, further comprising said antenna provides a directional radiation pattern.

21. The folded multilayer electrically small compact microstrip antenna, as recited in claim 20, further comprising a bottom dielectric substrate layer is positioned on top of said third conductive branch.

22. The folded multilayer electrically small compact microstrip antenna, as recited in claim 21, further comprising said antenna provides a resultant frequency of 125 MHz.

23. The folded multilayer electrically small compact microstrip antenna, as recited in claim 22, further comprising said shortened antenna length, $A_s$, being about five times shorter than said given length, $A_l$.

24. The folded multilayer electrically small compact microstrip antenna, as recited in claim 23, further comprising said antenna provides an electrical length of 190 mm.

25. The folded multilayer electrically small compact microstrip antenna, as recited in claim 24, further comprising an electrical length ratio of said antenna to a length of said top segment of 3.8:1.

26. A folded multilayer electrically small compact microstrip antenna, comprising:

a microstrip dielectric substrate having two dielectric substrate layers;

a means for a conductive ground plane;

a folding radiating strip folded into a plurality of segments is interleaved with said dielectric substrate layers and said conductive ground plane means;

a top segment is stacked on a top dielectric substrate layer, said top dielectric substrate layer is stacked on said conductive ground plane means;

said top segment having a narrow portion, a narrow end and a wide portion;

a coaxial connector, orthogonal to said dielectric substrate layers, having an outer portion and a center pin, said outer portion being connected to said conductive ground plane means, said center pin being connected to said narrow end in the vicinity of a point where said top segment is shorted to said conductive ground plane means and an optimal impedance match is provided;

said wide portion, having a central region near said narrow portion and a junction point opposing said narrow end, provides a given impedance;

said antenna having a given length, $A_l$;

said plurality of dielectric layers having an effective impedance value; and said narrow portion causing a reduced effective impedance at said junction point to provide a shortened antenna length, $A_s$, that operates at VHF and HF frequencies with an omnidirectional radiation pattern.

27. The folded multilayer electrically small compact microstrip antenna, as recited in claim 26, further comprising one of said dielectric substrate layers being thicker than one of said segments.

28. The folded multilayer electrically small compact microstrip antenna, as recited in claim 27, further comprising said conductive ground plane means being thinner than one of said dielectric substrate layers.

29. The folded multilayer electrically small compact microstrip antenna, as recited in claim 28, further comprising said folding radiating strip being composed of a first metal.

30. The folded multilayer electrically small compact microstrip antenna, as recited in claim 29, further comprising said conductive ground plane means being composed of a second metal.

31. The folded multilayer electrically small compact microstrip antenna, as recited in claim 30, wherein said first metal is copper.

32. The folded multilayer electrically small compact microstrip antenna, as recited in claim 31, further comprising said second metal being selected from the group consisting of aluminum and copper.

33. The folded multilayer electrically small compact microstrip antenna, as recited in claim 32, further comprising said antenna provides an omnidirectional radiation pattern.

34. A folded multilayer electrically small compact microstrip antenna, comprising:

a microstrip dielectric substrate having three dielectric substrate layers;

a means for a conductive ground plane having a plurality of conductive branches;

a folding radiating strip folded into a plurality of segments is interleaved with said dielectric substrate layers and said plurality of conductive branches;

a top segment is stacked on a top dielectric substrate layer, said top dielectric substrate layer is stacked on a first conductive branch and a bottom dielectric substrate layer is positioned on top of a second conductive branch;

said top segment having a narrow portion, a narrow end and a wide portion;

a coaxial connector, orthogonal to said dielectric substrate layers, having an outer portion and a center pin, said outer portion being connected to said first conductive branch, said center pin being connected to said narrow end in the vicinity of a point where said top segment is shorted to said first conductive branch and an optimal impedance match is provided;

said wide portion, having a central region near said narrow portion and a junction point opposing said narrow end, provides a given impedance;

said antenna having a given length, $A_l$;

said plurality of dielectric layers having an effective impedance value; and said narrow portion causing a reduced effective impedance at said junction point to provide a shortened antenna length, $A_s$, that operates at VHF and HF frequencies with a directional radiation pattern.

35. The folded multilayer electrically small compact microstrip antenna, as recited in claim 34, further comprising one of said dielectric substrate layers having a thickness greater than one of said plurality of segments.

36. The folded multilayer electrically small compact microstrip antenna, as recited in claim 35, further comprising said first conductive branch being thinner than one of said dielectric substrate layers.

37. The folded multilayer electrically small compact microstrip antenna, as recited in claim 36, further comprising:

said second conductive branch being thinner than one of said dielectric substrate layers; and said second conductive branch being positioned below said first conductive branch.

38. The folded multilayer electrically small compact microstrip antenna, as recited in claim 37, further comprising a bottom dielectric substrate layer being positioned on top of said second conductive branch.

39. The folded multilayer electrically small compact microstrip antenna, as recited in claim 38, further comprising said antenna provides a resultant frequency of about/at least 191 MHz.

40. The folded multilayer electrically small compact microstrip antenna, as recited in claim 39, further comprising said shortened antenna length, $A_s$, being about three times shorter than said given length, $A_l$.

41. A folded multilayer electrically small compact microstrip antenna, comprising:

a microstrip dielectric substrate having five dielectric substrate layers;

a means for a conductive ground plane having a first conductive branch, a second conductive branch and a third conductive branch;

a folding radiating strip folded into a plurality of segments is interleaved with said dielectric substrate layers and said conductive ground plane means;

a top segment is stacked on a top dielectric substrate layer, said top dielectric substrate layer is stacked on said first conductive branch;

said top segment having a narrow portion, a narrow end and a wide portion;

a coaxial connector, orthogonal to said dielectric substrate layers, having an outer portion and a center pin, said outer portion being connected to said first conductive branch, said center pin being connected to said narrow end in the vicinity of a point where said top segment is shorted to said first conductive branch and an optimal impedance match is provided;

said wide portion, having a central region near said narrow portion and a junction point opposing said narrow end, provides a given impedance;

said antenna having a given length, $A_l$;

a top dielectric substrate layer is positioned on top of said first conductive branch and a bottom dielectric substrate layer is positioned on top of said third conductive branch;

said plurality of dielectric layers having an effective impedance value; and said narrow portion causing a reduced effective impedance at said junction point to provide a shortened antenna length, $A_s$, that operates at VHF and HF frequencies with a directional radiation pattern.

42. The folded multilayer electrically small compact microstrip antenna, as recited in claim 41, further comprising one of said dielectric substrate layers having a thickness greater than one of said plurality of segments.

43. The folded multilayer electrically small compact microstrip antenna, as recited in claim 42, further comprising said first conductive branch, said second conductive branch and said third conductive branch each being thinner than one of said dielectric substrate layers.

44. The folded multilayer electrically small compact microstrip antenna, as recited in claim 43, further comprising:

said second conductive branch disposed below said first conductive branch; and said third conductive branch disposed below said second conductive branch.

45. The folded multilayer electrically small compact microstrip antenna, as recited in claim 44, further comprising said bottom dielectric substrate layer is positioned on top of said third conductive branch.

46. The folded multilayer electrically small compact microstrip antenna, as recited in claim 45, further comprising said antenna provides a resultant frequency of 125 MHz.

47. The folded multilayer electrically small compact microstrip antenna, as recited in claim 46, further comprising said shortened antenna length, $A_s$, being about five times shorter than said given length, $A_l$.

48. The folded multilayer electrically small compact microstrip antenna, as recited in claim 47, further comprising said antenna provides an electrical length of 190 mm.

49. The folded multilayer electrically small compact microstrip antenna, as recited in claim 48, further comprising an electrical length ratio of said antenna to a length of said top segment of 3.8:1.

50. A method for placing a folding radiation strip around multilayer microstrip dielectric substrates in electrically small compact microstrip antenna, comprising the steps of:

forming said multilayer microstrip dielectric substrate from a plurality of dielectric substrate layers, said antenna having a given length, $A_l$;

constructing a conductive ground plane means with a plurality of conductive branches;

forming said folding radiating strip into a plurality of segments, including a top segment having a narrow portion, a narrow end and a wide portion;

interleaving said folding radiating strip, said plurality of dielectric substrate layers and said plurality of conductive branches;

connecting a coaxial connector to a first conductive branch, said coaxial connector having an outer portion and a center pin, said outer portion being connected to said first conductive branch, said center pin being connected to said narrow end in the vicinity of a point where said top segment is shorted to said first conductive branch and an optimal impedance match is provided;

said wide portion, having a central region near said narrow portion and a junction point opposing said narrow end, provides a given impedance;

pointing said narrow end to said coaxial connector;

providing a given impedance by placing said wide portion near a junction point opposing said narrow end;

positioning a top dielectric substrate layer on top of said first conductive branch, said plurality of dielectric substrate layers having an effective impedance value;

said narrow portion causing a reduced effective impedance at said junction point; and providing a shortened antenna length, $A_s$, that operates at VHF and HF frequencies due to said reduced impedance.

51. The method for placing the folding radiation strip around multilayer microstrip dielectric substrates in electrically small compact microstrip antenna, as recited in claim 50, wherein said shortened antenna length, $A_s$, is less than said given length, $A_l$.

52. The method for placing the folding radiation strip around multilayer microstrip dielectric substrates in electrically small compact microstrip antenna, as recited in claim 51, wherein said folding radiating strip is composed of a first metal.

53. The method for placing the folding radiation strip around multilayer microstrip dielectric substrates in electrically small compact microstrip antenna, as recited in claim 52, wherein said conductive ground plane means is composed of a second metal.

54. The method for placing the folding radiation strip around multilayer microstrip dielectric substrates in electrically small compact microstrip antenna, as recited in claim 53, wherein said second metal is selected from the group consisting of aluminum and copper.

55. The method for placing the folding radiation strip around multilayer microstrip dielectric substrates in electrically small compact microstrip antenna, as recited in claim 52, wherein said first metal is copper.

56. The method for placing the folding radiation strip around multilayer microstrip dielectric substrates in electrically small compact microstrip antenna, as recited in claim 52, further comprising the step of forming one of said plurality of dielectric substrate layers thicker than one of said plurality of segments.

57. The method for placing the folding radiation strip around multilayer microstrip dielectric substrates in electrically small compact microstrip antenna, as recited in claim 56, further comprising the step of forming said first conductive branch thinner than one of said plurality of dielectric substrate layers.

58. The method for placing the folding radiation strip around multilayer microstrip dielectric substrates in electrically small compact microstrip antenna, as recited in claim 57, further comprising the step of disposing said coaxial connector orthogonal to said plurality of dielectric substrate layers.

59. The method for placing the folding radiation strip around multilayer microstrip dielectric substrates in electrically small compact microstrip antenna, as recited in claim 58, wherein said plurality of dielectric substrate layers is two layers.

60. The method for placing the folding radiation strip around multilayer microstrip dielectric substrates in electrically small compact microstrip antenna, as recited in claim 59, further comprising the step of said antenna providing an omnidirectional radiation pattern.

61. The method for placing the folding radiation strip around multilayer microstrip dielectric substrates in electrically small compact microstrip antenna, as recited in claim 58, wherein said plurality of dielectric substrate layers is three layers.

62. The method for placing the folding radiation strip around multilayer microstrip dielectric substrates in electrically small compact microstrip antenna, as recited in claim 61, further comprising the step of positioning a second conductive branch below said first conductive branch.

63. The method for placing the folding radiation strip around multilayer microstrip dielectric substrates in electrically small compact microstrip antenna, as recited in claim 62, further comprising the step of said antenna providing a directional radiation pattern.

64. The method for placing the folding radiation strip around multilayer microstrip dielectric substrates in electrically small compact microstrip antenna, as recited in claim 63, further comprising the step of stacking a bottom dielectric substrate layer on said second conductive branch.

65. The method for placing the folding radiation strip around multilayer microstrip dielectric substrates in electrically small compact microstrip antenna, as recited in claim 64, further comprising the step of said antenna providing a resultant frequency of 191 MHz.

66. The method for placing the folding radiation strip around multilayer microstrip dielectric substrates in electrically small compact microstrip antenna, as recited in claim 65, wherein said shortened antenna length, $A_s$, is about three times shorter than said given length, $A_l$.

67. The method for placing the folding radiation strip around multilayer microstrip dielectric substrates in electrically small compact microstrip antenna, as recited in claim 58, wherein said plurality of dielectric substrate layers is five layers.

68. The method for placing the folding radiation strip around multilayer microstrip dielectric substrates in electrically small compact microstrip antenna, as recited in claim 67, further comprising the steps of:

positioning a second conductive branch below said first conductive branch;

positioning a third conductive branch below said second conductive branch;

forming said second conductive branch thinner than one of said plurality of dielectric substrate layers; and forming said third conductive branch thinner than one of said plurality of dielectric substrate layers.

69. The method for placing the folding radiation strip around multilayer microstrip dielectric substrates in electrically small compact microstrip antenna, as recited in claim 68, further comprising the step of said antenna providing a directional radiation pattern.

70. The method for placing the folding radiation strip around multilayer microstrip dielectric substrates in electrically small compact microstrip antenna, as recited in claim 69, further comprising the step of stacking a bottom dielectric substrate layer on top of said third conductive branch.

71. The method for placing the folding radiation strip around multilayer microstrip dielectric substrates in electrically small compact microstrip antenna, as recited in claim 70, further comprising the step of said antenna providing a resultant frequency of 125 MHz.

72. The method for placing the folding radiation strip around multilayer microstrip dielectric substrates in electrically small compact microstrip antenna, as recited in claim 71, wherein said shortened antenna length, $A_s$, is about five times shorter than said given length, $A_l$.

73. The method for placing the folding radiation strip around multilayer microstrip dielectric substrates in electrically small compact microstrip antenna, as recited in claim 72, further comprising the step of said antenna providing an electrical length of 190 mm.

74. The method for placing the folding radiation strip around multilayer microstrip dielectric substrates in electrically small compact microstrip antenna, as recited in claim 73, wherein an electrical length ratio of said antenna to a length of said top segment is 3.8:1.

* * * * *